US005474396A

United States Patent [19]

Bravo

[11] Patent Number: 5,474,396

[45] Date of Patent: Dec. 12, 1995

[54] WATERTIGHT SEALING SYSTEM FOR MANHOLE

[76] Inventor: Sergio M. Bravo, 2872 Tigertail Dr., Los Alamitos, Calif. 90720

[21] Appl. No.: 286,136

[22] Filed: Aug. 4, 1994

[51] Int. Cl.[6] ..... E02D 29/14

[52] U.S. Cl. ..... 404/26; 52/20

[58] Field of Search ..... 404/25, 26; 52/19, 52/20

[56] References Cited

U.S. PATENT DOCUMENTS 3,973,856 8/1976 Gaglioti ..... 404/25

5,044,822 9/1991 Moss ..... 404/25

*Primary Examiner*—William P. Neuder

*Attorney, Agent, or Firm*—Christie, Parker & Hale

[57] ABSTRACT

A sealing assembly for sealing a manhole against entering liquid includes a guide ring with an adjustable diameter and set screws for pressing against interior walls of the manhole when the diameter of the guide ring is set to approximately the diameter of the manhole walls, a sealing ring for resting on top of the guide ring and an expandable ring disposed at the inner periphery of the sealing ring and expanded to compress the sealing ring against the walls of the manhole to provide a liquid-tight seal. The sealing assembly also includes a lid positioned on top of the sealing ring. The lid preferably has a removable portion to allow access through the lid without taking the lid off of the sealing ring and without destroying the integrity of the caulking. In a method of sealing a manhole, there is a step of fixing a guide ring to the interior walls of the manhole, placing the sealing ring on top of the guide ring, placing an expandable ring at the interior of the sealing ring and expanding the expandable ring so that it presses against the sealing ring to compress the sealing ring against the walls of the manhole to provide a liquid-tight seal, and placing a lid on top of the sealing ring. A simplified version of the sealing assembly and method involves using the weight of the manhole cover to compress a gasket against the interior walls of the manhole.

8 Claims, 5 Drawing Sheets

WATERTIGHT SEALING SYSTEM FOR MANHOLE

FIELD OF THE INVENTION

The present invention relates to watertight sealing systems for manholes, and, in particular, to a watertight sealing system which may easily be retrofit into an existing manhole.

BACKGROUND OF THE INVENTION

In gasoline service stations, there is normally a submersible pump for pumping gasoline from an underground storage tank to a gasoline-dispensing pump. This submersible pump is typically located in a manhole. The manhole is normally formed by a metal cylindrical container known as a manhole skirt having a substantially flat bottom and a top suitable for receiving a manhole cover. The submersible pump is located at the bottom of the manhole. To detect the presence of leaking gasoline which will collect within the manhole, a sensor is provided. It is desirable to make this sensor relatively sensitive to detect small amounts of gasoline to avoid accumulation of large amounts of gasoline and the obvious fire hazard. Unfortunately, the typical sensor cannot tell the difference between gasoline and other liquids such as water. Therefore, if the seal between the manhole and the manhole cover is not watertight, water can leak into the manhole and set off the sensor, which results in shutting down of the submersible pump. This is a problem not only if it rains, but also if a hose is used to wash down the pavement at the service station. When the submersible pump shuts down, customers will not be able to pump gasoline and will take their business elsewhere. Accordingly, to avoid the loss of customers as well as the inconvenience of having to reset the system or the hazard of deactivating the sensor, it would be desirable to prevent water from entering the manhole. Moreover, any water which gets into the system will be contaminated with gasoline and must be disposed of as a hazardous material, which is expensive.

Entry of water into manholes of all types such as for telephone equipment and electrical equipment can be prevented with the invention. Water can damage such equipment, corrode it, and make it cumbersome and dangerous to work on such equipment.

SUMMARY OF THE INVENTION

In one embodiment, the present invention is a system for sealing a manhole against water or other liquids including an annular gasket, a setting ring or guide ring which can be biased outward against inner walls of the manhole, the gasket being disposed on top of the guide ring, and an expansion ring for contacting the inside of the gasket and compressing the gasket in a radially outward direction against the walls of the manhole. Preferably, caulking is used at the junction of the metal plate and the gasket and at the junction of the retainer ring and gasket.

According to a preferred embodiment, the guide ring includes a compressible outer ring and a metallic inner ring having set screws disposed therein. The set screws may be used to compress the compressible material and thus bias it in an outward direction to fix the retainer ring at a suitable height in the manhole where the gasket is to rest. The gasket also preferably includes a compressible material. These materials are preferably non-corrosive with regard to gasoline.

In a further preferred embodiment, the metal plate has a handle on its upper main surface and an openable/closable disk which may be opened to view the gasoline-handling equipment and sensor at the bottom of the manhole, and may be closed to reseal against liquid.

BRIEF DESCRIPTION OF THE DRAWINGS

A better understanding of the invention and its advantages will be gained by reading the detailed description below in conjunction with the drawings in which.

DETAILED DESCRIPTION OF THE PREFERRED EMBODIMENTS

Figure 1:
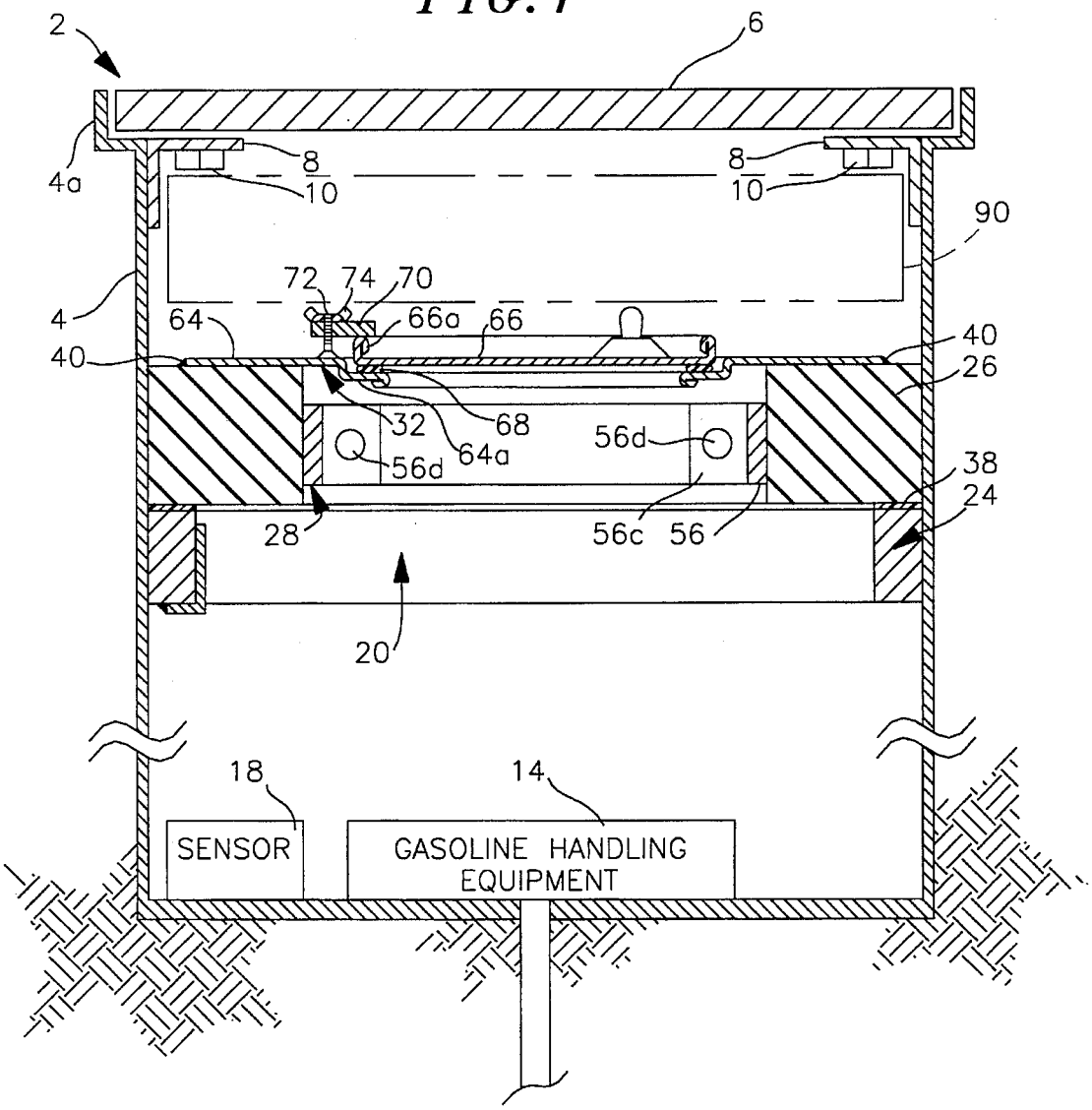
FIG. 1 is a sectional view of a manhole including a sealing system according to the invention.

In a preferred embodiment, a sealing system for a manhole against entry of liquids is disposed inside the manhole below the manhole cover. With reference to FIG. 1, a manhole generally indicated by reference numeral 2 includes a manhole skirt 4 having a manhole ring **4*a* at its upper periphery for receiving a manhole cover 6. The skirt 4 is disposed in the ground of a service station (not shown). Cover 6 is preferably flush with the cement surface of the station. The cover 6 may have several small sections of angle iron 8 connected to its underside by bolts 10**, or the angle iron may be annular in shape. This helps seat the cover with the manhole skirt.

At the bottom of the manhole, there is gasoline-handling equipment 14 which typically is a submersible pump for pumping gasoline from the underground storage tank to the gasoline dispensing pumps. A sensor 18 is also located at the bottom of the manhole to detect the presence of leaking gasoline. Unfortunately, typical sensors cannot tell the difference between different liquids, so if water gets into the manhole, sensor 18 will be triggered. The station's pumps will be either manually shut down by the station operator in response to seeing an indication that the sensor has sensed liquid, or automatically shut down if the sensor is connected to an automatic shut-off switch or valve.

Also shown in FIG. 1 is the sealing system according to the invention, generally indicated by reference numeral 20. The sealing system 20 includes an annular retainer ring or guide ring 24 for supporting a rubber gasket 26. There is also an expansion ring 28 for pressing radially outward on the rubber gasket, and a lid 32 disposed on top of the gasket. Caulking 38, 40 may be provided between the retainer ring 24 and the gasket 26 and on top of the gasket 26 at the periphery of the lid 32.

Figure 2:
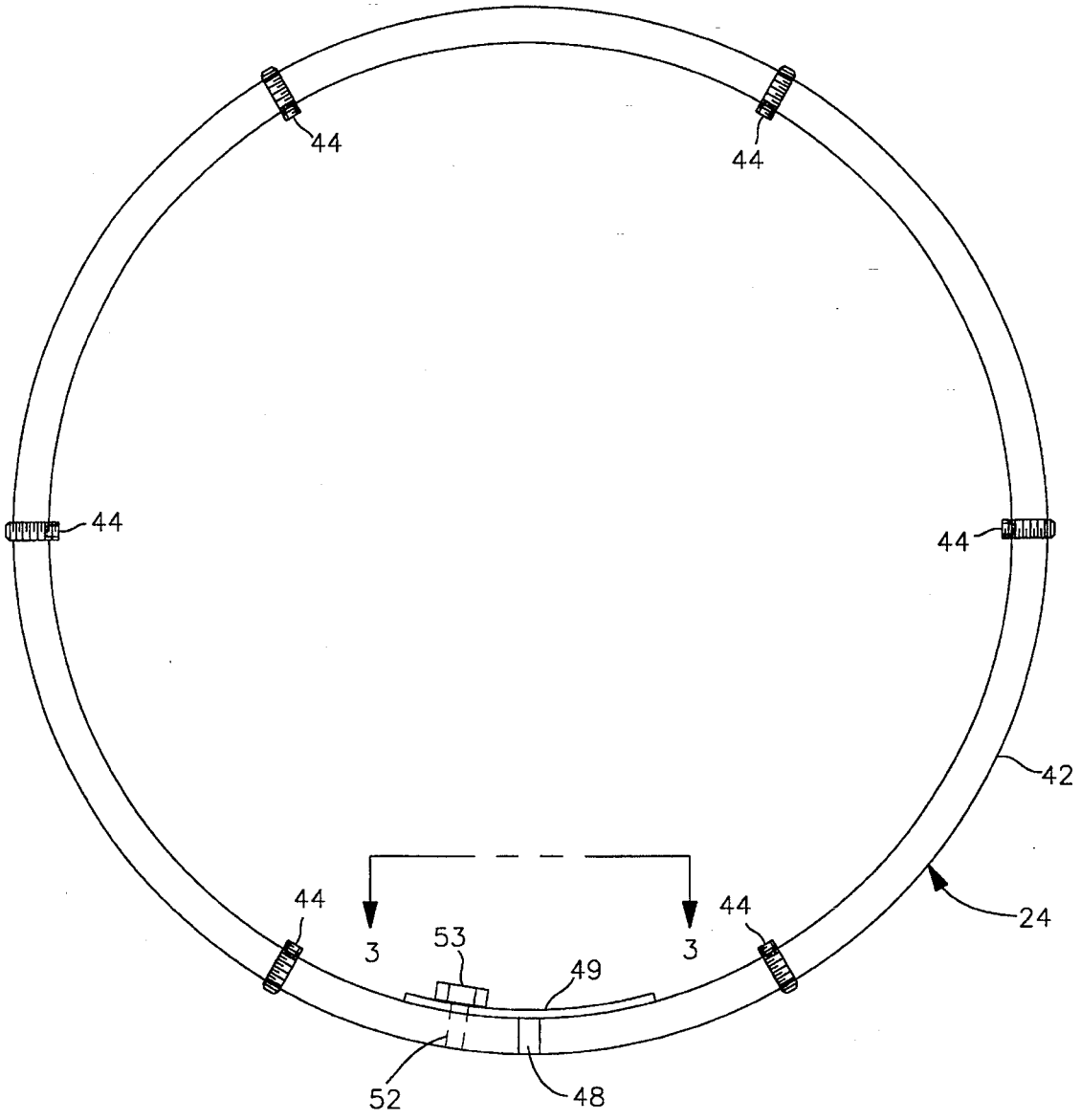
FIG. 2 is a top, partial cutaway view of a guide or retainer ring in the sealing system of FIG. 1.
Figure 3:
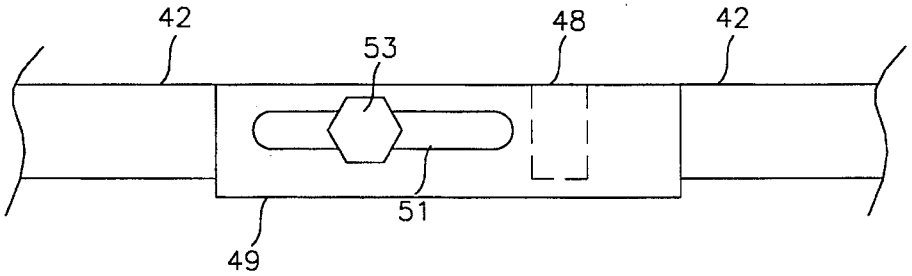
FIG. 3 is a partial side view of a portion of the retainer ring taken along lines 3—3 of FIG. 2.

Details of the retainer ring 24 are shown in FIGS. 2 and 3. The ring preferably comprises an annular body 42 preferably of steel, and a plurality of set screws 44 passing through the body 42 which may be actuated to press radially outwardly against the manhole skirt 4 to fix the position of the ring 24. The body 42 preferably has a small gap 48 in it to allow the ring to be retracted or expanded to fit within manhole skirts of varying sizes. A small metal plate 49 is fixed, e.g., by welding, to an inner edge of body 42 adjacent gap 48. There is a slot 51 formed in the metal plate 49 on the other side of gap 48 from which the plate 49 is fixed to body 42. On the same side of body 42 as the slot is formed in plate 49, there is a threaded hole 52 for receiving a bolt 53 for fastening the metal plate 49 to the body 42 at a desired location in slot 51 so as to make the body 42 substantially equal in outer periphery to the inner periphery of the manhole skirt, at which point the set screws 44 may be rotated to press outwardly against the manhole skirt and thereby fix the retainer ring in position.

Gasket 26 is preferably of an elastomeric material or any other material capable of providing a sufficient seal against liquid when pressed outward against the walls of the manhole by the expansion ring 28. An example of such an elastomeric material is neoprene with an HR index of about 50 or 60 or more.

Figure 4:
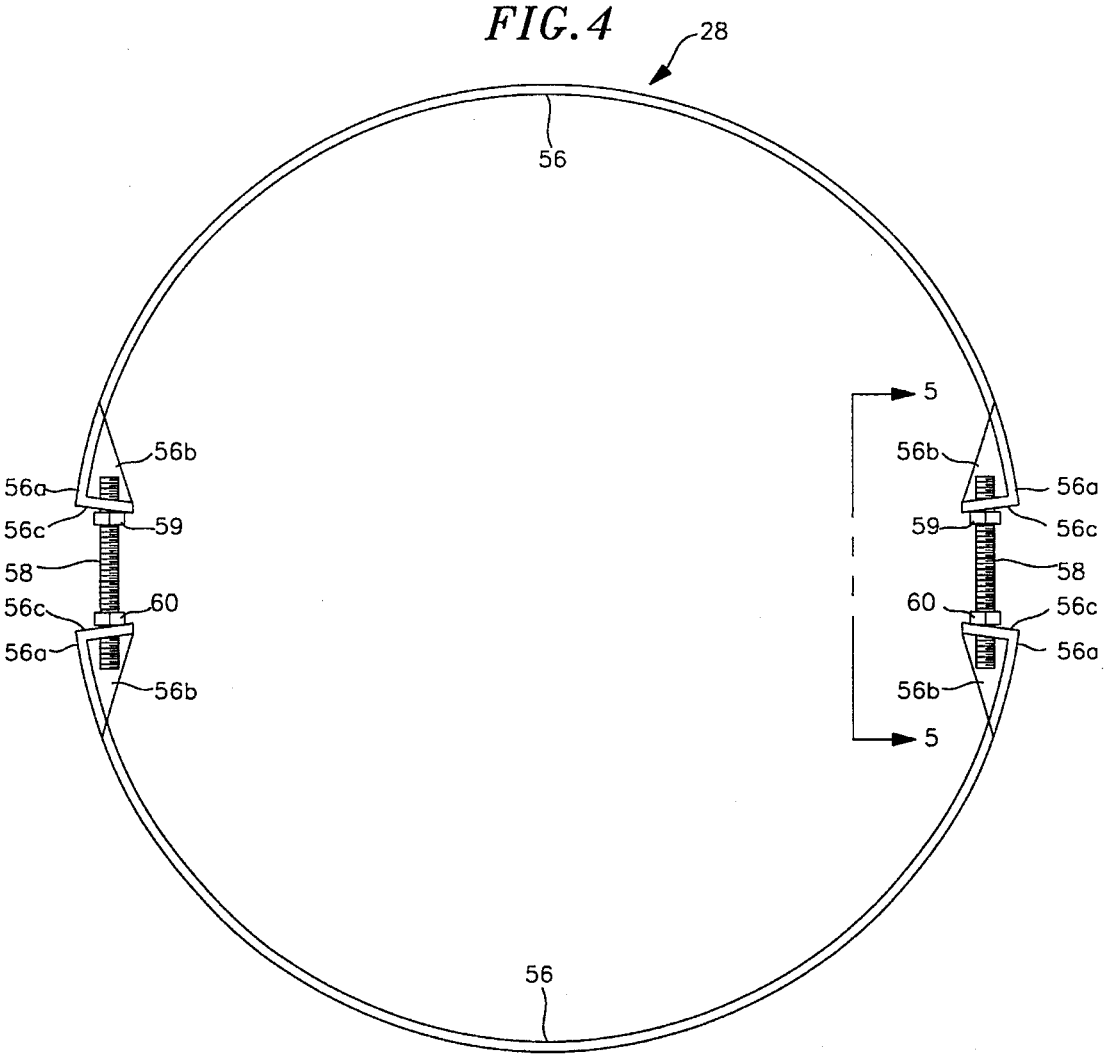
FIG. 4 is a top view an expansion ring of the sealing system of FIG. 1.
Figure 5:
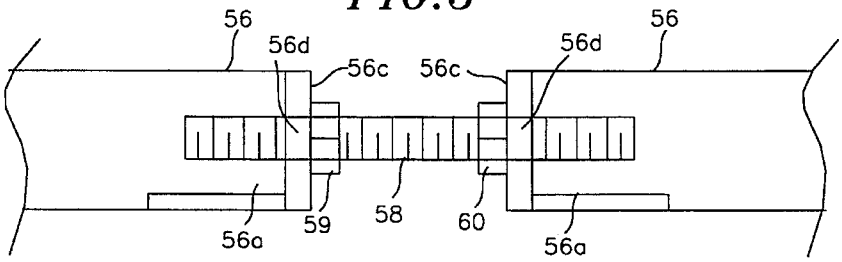
FIG. 5 is a side view of a portion of the expansion ring of FIG. 4 taken along lines 5—5.

Details of expansion ring 28 are shown in FIGS. 4 and 5. Ring 28 includes two substantially semicircular actuating bodies 56 with integrally or unitarily formed brackets **56*a* at their ends which include a web 56*b* for reinforcement and a perpendicular tab 56*c* so that bolts 58 may be fitted through holes 56*b* in each tab member 56*c*. Tightening nuts 59, 60 are threaded on the bolts 58. These tightening nuts 59, 60 may be adjusted towards each other or away from each other to tension or reduce tension on the expansion ring during installation. Reducing tension enables the expansion ring to fit inside the periphery of the rubber gasket 26 and then the nuts are tightened to have the expansion ring 28 press against the rubber gasket 26** to form the seal. The expansion ring, like the retainer ring, is preferably steel with epoxy paint.

Figure 6:
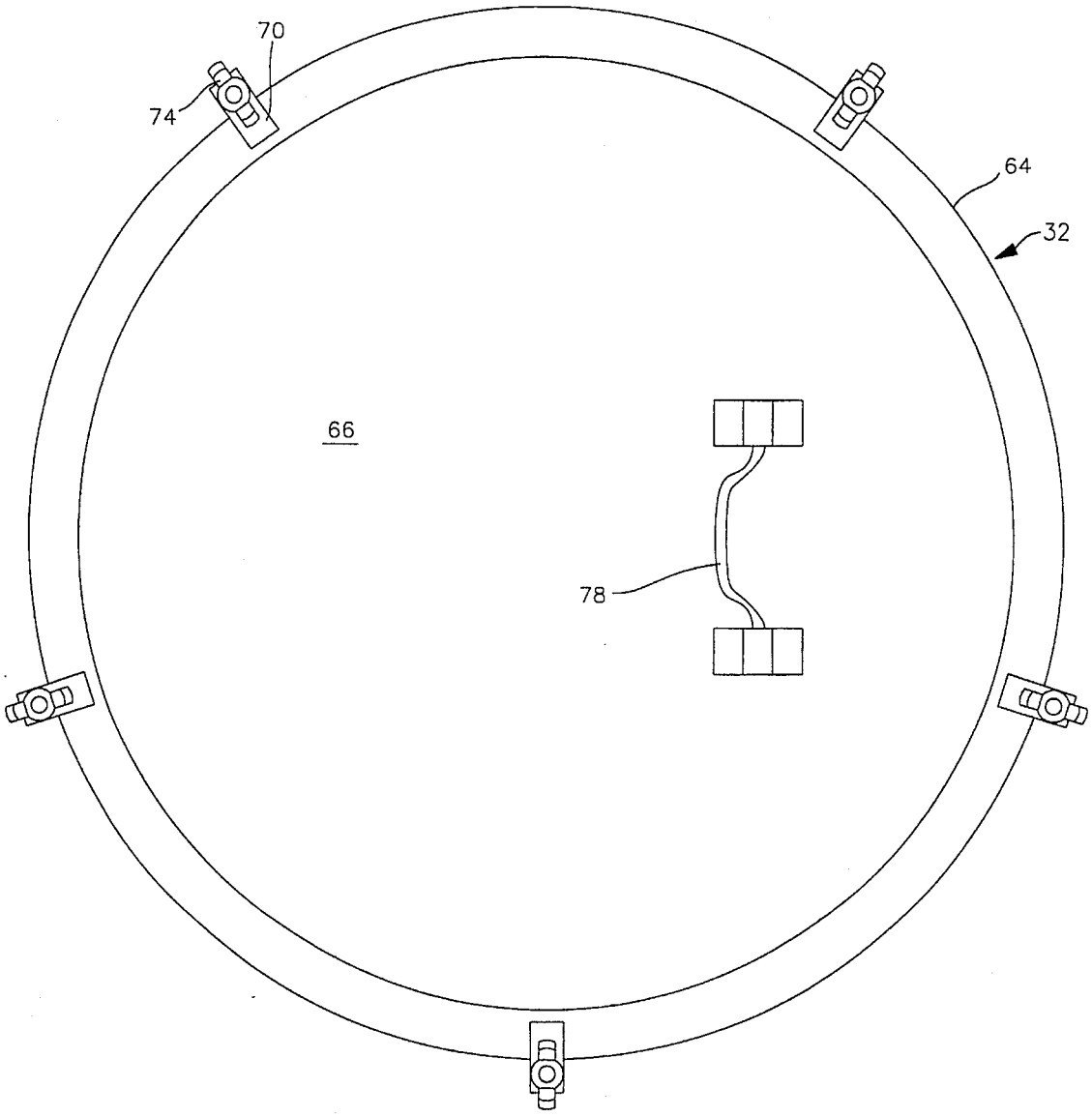
FIG. 6 is a top view of a metal lid of the sealing system of FIG. 1.

Details of lid 32 are shown in FIGS. 1 and 6. There is a large annular ring 64 and an inner disk 66 removably sealed to the outer ring 64, by means of an annular gasket 68 sitting in a lip **64*a* of the outer annular disk 64. The inner disk 66 has a tab edge 66*a* at which point a plurality of metal plates 70 press down on the disk 66 by means of bolts 72 welded or otherwise secured to the annular ring 64. The bolts 72 pass through the metal plates and are actuated by wing nuts 74 tightened on the bolts 72. With this structure, the wing nuts 74 may be loosened so that disk 66 can be removed to inspect and otherwise have access to the sensor 18 and gasoline-handling equipment 14, without disturbing the caulking 40 used to seal the annular ring 64 to the gasket 26. A handle 78 may be provided on the disk 66** to simplify lifting up and replacing the disk.

To install the sealing assembly in the manhole, manhole cover 6 is removed and the depth of the assembly, i.e., the depth at which the retainer ring 24 must be installed, is preferably marked on the manhole skirt. One way to do this is by means of a substantially L-shaped tool where one end of the L carries a marking utensil and the other part of the L is used as a guide flush with the surface of the service station. When the tool is moved in a circle around the surface of the service station, the marking utensil marks the appropriate depth of installation on the inside of the manhole skirt. Preferably, the marking utensil is telescopically attached to the L-shaped tool so that the desired depth at which the tool will mark a circle around the manhole skirt may be adjusted as needed for the particular installation.

The annular ring is placed inside the manhole and positioned in line with the markings. The body 42 is expanded or contracted to provide a rough fit. If slot 48 does not provide enough play to reduce the size of the body 42 to fit the diameter of the manhole skirt, some of the body 42 can be cut off the end of the body where the threaded hole 52 is provided, at least until a point where the integrity of the threaded hole is about to be threatened. When body 42 is in rough position, bolt 53 is tightened and then set screws 44 are actuated to press outwardly and fix the position of the ring. (The expansion ring, and other elements, are manufactured in different size increments, such as 31", 32", 33", and 34" diameters to fit most or all size manholes with limited adjustments.) The caulking 38 may then be provided on top of the retainer ring and then the rubber gasket is placed on top of that. The expansion ring 28 is then positioned at the inner periphery of gasket 26 and the nuts 59, 60 are rotated away from each other to tension the ring and force the gasket 26 against the manhole skirt to form a seal. The lid 32 is then placed on top of the gasket 26 and caulking 40 may be used around the periphery of the lid.

Preferably, the height of installation of the sealing ring is selected so that there is between 1 and 2 inches of clearance to the manhole cover, so that only a minimum of water can collect above the sealing assembly. Moreover, it is preferable to install foam 90, such as styrofoam, between the cover and lid to further minimize water collection and to help minimize the effects, if any, of freezing and thawing. The foam is preferably formed in four quarters.

Figure 7:
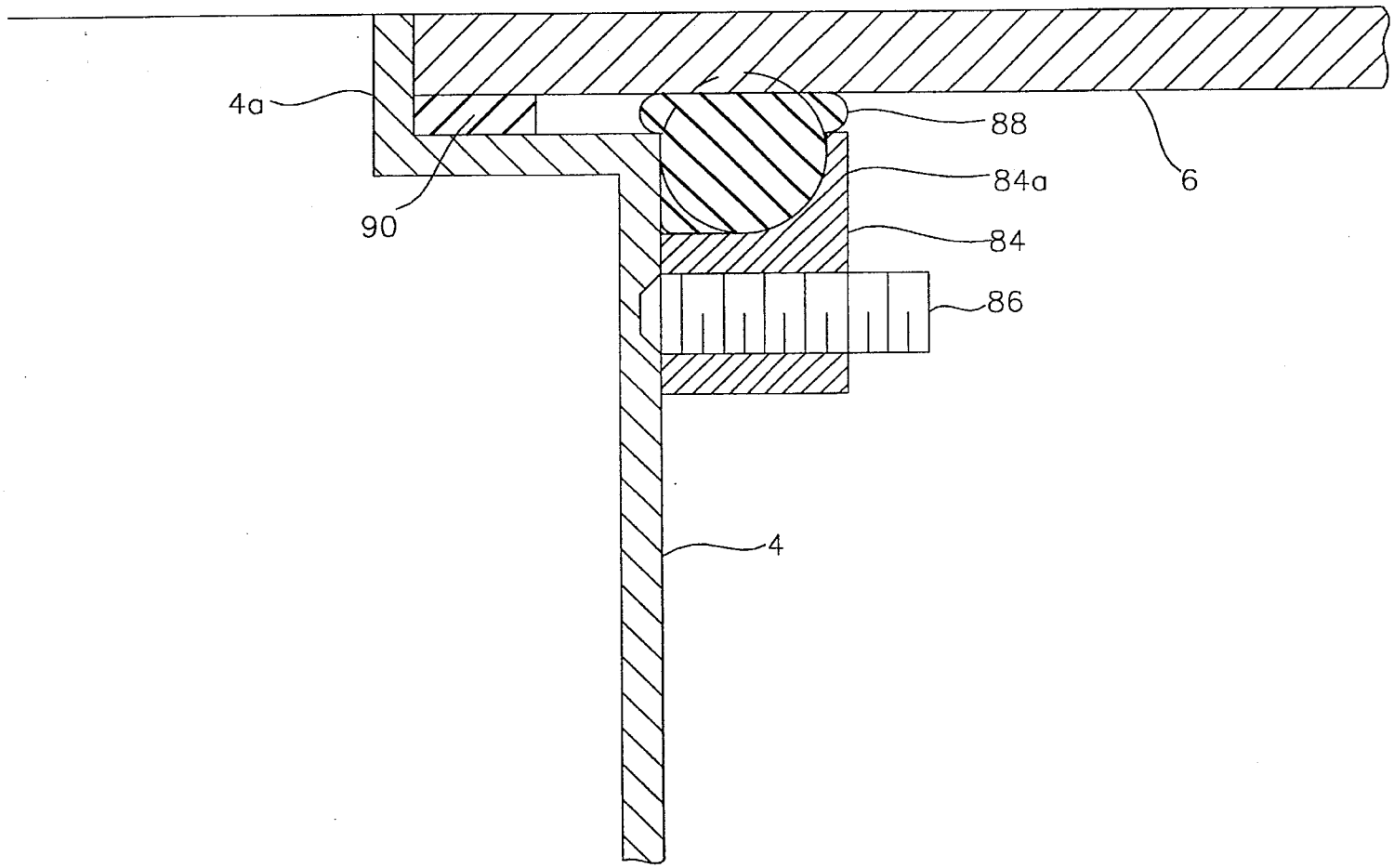
FIG. 7 is a partial sectional view of a sealing system of a second embodiment according to the invention.

A second embodiment of the invention is shown in FIG. 7. In this version, a guide ring 84 is constructed the same or substantially the same as the guide or retainer ring of the prior embodiment, except that the top portion **84*a* of the guide ring has a greater height at the interior of the ring than the exterior to provide a pocket for sealing an annular gasket 88 preferably having a round cross section (shown in dashed lines). The guide ring 84 is placed in rough position just below the manhole cover, and the set screws are tightened. The highest part of the guide ring is no higher than the manhole ring's bottom, or just slightly higher if an outer gasket is used as explained below. The gasket 88 is placed or forced into the pocket formed by the ring 84 and manhole skirt 4. An outer annular gasket 90 of flat section may then be placed around the manhole ring and the manhole cover is placed on the gaskets 88 and 90, thereby compressing the gasket 88 into the position shown in solid lines in FIG. 7** to form a liquid-tight seal.

The embodiments of the invention described herein are exemplary. For example, the manhole, and thus the various parts of the invention, may have a square or rectangular shape. The scope of the invention is not limited to such embodiments, but rather is defined by the appended claims as interpreted in accordance with law and equity.

What is claimed:

1. A sealing assembly for sealing a manhole against entering liquid, the sealing assembly comprising:

(a) first ring means actuable for pressing against interior walls of the manhole in order to provide a supporting surface;

(b) a sealing ring for resting on top of the supporting surface;

(c) second ring means disposed at an interior of the sealing ring actuable for pressing against the sealing ring to compress the sealing ring against the walls of the manhole to provide a liquid-tight seal;

(d) a lid disposed on top of the sealing ring and having means for opening the lid to provide a person with access below the assembly; and (e) means for providing a liquid-tight seal between the lid and the sealing ring.

2. The assembly of claim 1 wherein the means for providing a liquid-tight seal comprises caulking.

3. The assembly of claim 1 further comprising caulking between the sealing ring and the first ring means.

4. The assembly of claim 1 wherein the first ring means comprises an annular ring having a slot therethrough and means for adjusting a size of the slot to adjust a diameter of the annular ring.

5. The assembly of claim 4 wherein the annular ring has set screws disposed therein actuable for pressing against the walls of the manhole and for releasing pressure against the walls of the manhole.

6. The assembly of claim 1 wherein the sealing ring comprises an elastomeric material.

7. The assembly of claim 1 wherein the second ring means comprises two arc members, and means for attaching the arc members to each other at respective ends and for adjusting a distance between the arc members to increase a diameter of the second ring means to press against the sealing ring and to decrease the diameter thereof to reduce pressure.

8. The assembly of claim 1 wherein the lid comprises a first lid element for resting on the sealing ring and the means for opening comprises a second lid element and means for removably attaching the second lid element to the first lid element to allow access past the lid without removing the first lid element.

* * * * *